US006860096B2

(12) United States Patent
Stahlecker

(10) Patent No.: US 6,860,096 B2
(45) Date of Patent: Mar. 1, 2005

(54) ARRANGEMENT FOR OPEN-END ROTOR SPINNING

(75) Inventor: Gerd Stahlecker, Eislingen/Fils (DE)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 10/300,876

(22) Filed: Nov. 21, 2002

(65) Prior Publication Data

US 2003/0093986 A1 May 22, 2003

(30) Foreign Application Priority Data

Nov. 21, 2001 (DE) ..... 101 57 077

(51) Int. Cl.[7] ..... D01H 11/00; B08B 5/02
(52) U.S. Cl. ..... 57/301; 57/407
(58) Field of Search ..... 57/300–302, 404, 57/406, 407; 15/300.1, 301, 312.1, 316.1, 340.1, 405; 384/610

(56) References Cited

U.S. PATENT DOCUMENTS 4,514,972 A * 5/1985 Stahlecker ..... 57/301
RE32,670 E * 5/1988 Stahlecker ..... 57/301
4,835,957 A 6/1989 Stahlecker et al. ..... 57/301
4,936,086 A * 6/1990 Carter et al. ..... 57/304
4,962,638 A * 10/1990 Lane ..... 57/301
5,361,572 A * 11/1994 Uematsu et al. ..... 57/304
5,855,110 A * 1/1999 Bock et al. ..... 57/406
5,904,038 A * 5/1999 Stahlecker ..... 57/406
5,927,869 A 7/1999 Zott ..... 384/610

FOREIGN PATENT DOCUMENTS

EP 0019595 A1 * 11/1980 ..... D01H/7/885

* cited by examiner

*Primary Examiner*—John J. Calvert
*Assistant Examiner*—Shaun R Hurley
(74) *Attorney, Agent, or Firm*—Crowell & Moring LLP

(57) ABSTRACT

An arrangement for an open-end rotor spinning comprises a spinning rotor which is radially supported with a rotatable shaft in a wedge-shaped gap of two supporting disc pairs and axially in a step bearing housing. The shaft can be pulled out from its support from the operator's side of the arrangement and inserted again into the support. For the purpose of cleaning the gap between the back supporting disc pair and the front face side of the step bearing housing, a tube is provided having an entry opening at the operator's side of the arrangement and leading to the area of the step bearing housing and aligned against the shaft with an opening.

11 Claims, 1 Drawing Sheet

ARRANGEMENT FOR OPEN-END ROTOR SPINNING

BACKGROUND AND SUMMARY OF THE INVENTION

This application claims the priority of German Application No. 10157077.5 filed Nov. 21, 2001, the disclosure of which is expressly incorporated by reference herein.

The present invention relates to an arrangement for open-end rotor spinning comprising a spinning rotor having a rotatable shaft supported radially in wedge-shaped gaps between two supporting disc pairs and axially in a step bearing housing in such a way that the shaft can be pulled out of the support from the operator's side of the arrangement and inserted again into the support.

An arrangement of this type is prior art in U.S. Pat. No. 5,927,869. The known arrangement functions together with a step bearing housing, which comprises a lubricant cartridge having a step bearing ball for the shaft. Between the rear supporting disc pair and the front face side of the step bearing housing, a gap is present which often fills up with fiber fly. Thus a closed fiber ring forms around the rotating shaft. When the spinning rotor is taken out of its bearing, the fiber ring collapses. When the spinning rotor is subsequently inserted into its bearing again, fibers may be pushed by the shaft into the step bearing housing. Collected trash in the inside of the step bearing housing can, in certain circumstances, cause it to come to a standstill.

It is an object of the present invention to prevent a breakdown of the step bearing caused by fibers being pushed therein.

This object has been achieved in accordance with the present invention in that a tube is provided having an entry opening on the operator's side of the arrangement, which tube reaches into the area of the step bearing housing and which is aligned against the shaft with an opening.

When, for example, a travelling aggregate in the form of a piecing arrangement is active at the respective spinning aggregate, a blower for example belonging to the travelling aggregate can be arranged at the entry opening of the tube which blower generates an air stream into the tube. As a result of the placing of the opening of the tube in the above mentioned gap, the fiber ring is blown away from the shaft so that when the spinning rotor is pulled out and inserted back in again into its bearing, no fibers are pushed into the step bearing housing.

It is known in U.S. Pat. No. 4,835,957 that an open-end spinning aggregate is provided with diverse suction tubes which are aligned to various function elements and which, in addition to other functions, suction areas of the bearing. This publication, however, does not address the particular problems at the step bearing housing nor the solution to these problems.

These and further objects, features and advantages of the present invention will become more readily apparent from the following detailed description thereof when taken in conjunction with the accompanying drawings.

DETAILED DESCRIPTION OF THE DRAWINGS

Figure 1:
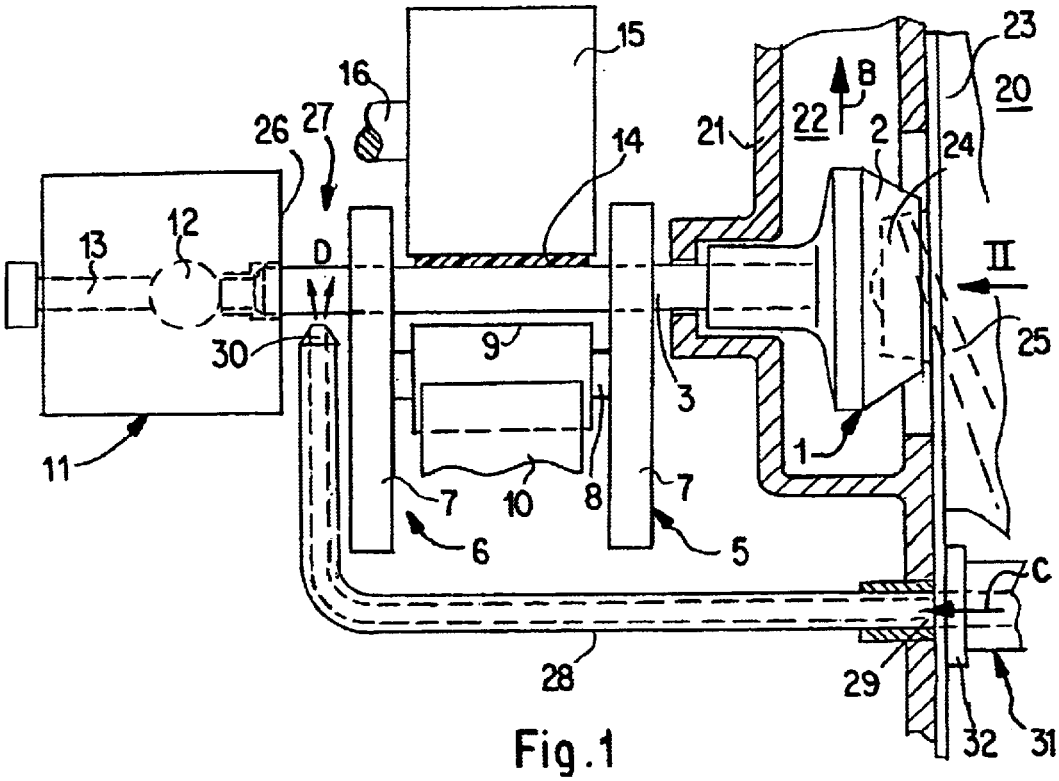
FIG. 1 is a part sectional side view of an arrangement constructed according to a preferred embodiment of the present invention.
Figure 2:
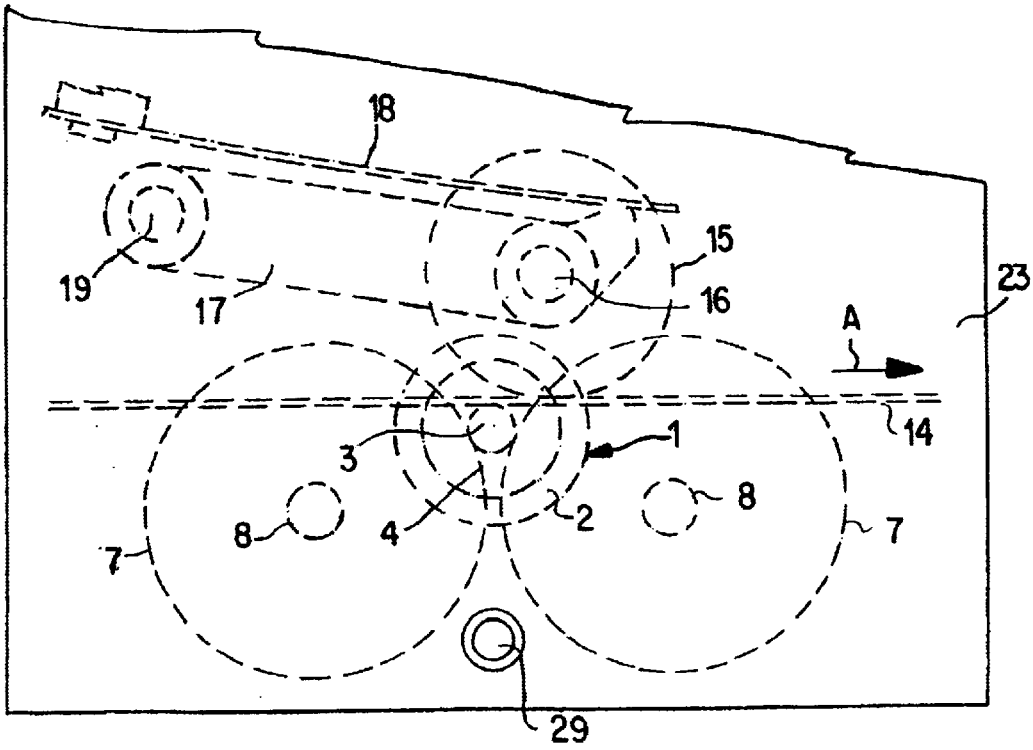
FIG. 2 is a view taken in the direction of arrow II of FIG. 1, whereby for reasons of clarity several components have been omitted.

The arrangement shown in FIGS. 1 and 2 comprises a rotatable spinning rotor 1, which in the known way comprises a rotor cup 2 and a shaft 3 affixed thereto.

The shaft 3 is radially supported in wedge-shaped gaps 4 between two supporting disc pairs 5 and 6. The shaft 3 is disposed on four supporting discs 7 overall and at the same time drives these. The axles 8 of the supporting discs 7 are supported each in a bearing housing 9, which in turn is affixed to a holding device 10 of the respective spinning aggregate.

A step bearing housing 11 is provided for the axial bearing of the spinning rotor 1, in which bearing housing 11 the end of the shaft 3 projects. In the inside of the step bearing housing 11, a step bearing ball 12 is located, which in turn is supported by an adjustable thrust bearing 13. In the inside of the step bearing housing 11 a lubricant cartridge (not shown) is located, which also surrounds the step bearing ball 12 and which provides the supporting surface between the shaft 3 and the step bearing ball 12 with lubricating grease.

The shaft 3 is driven by a tangential belt 14, which travels in travel direction A through the spinning machine and hereby drives all spinning rotors 1 of one machine side. The tangential belt 14 is loaded in the area of each spinning rotor 1 with a pressure roller 15, which is arranged in such a way that it is freely rotatable around an axle 16 on a swivel arm 17 and is also pressed against the tangential belt 14 by means of a loading spring 18. The swivel arm 17 can be swiveled around a stationary swivel axle 19.

The supporting disc pairs 5 and 6 are arranged in the known way slightly inclined towards one another, so that, in connection with the travel direction A of the tangential belt 14, an axial thrust onto the shaft 3 against the step bearing ball 12 is achieved. Thus the spinning rotor 1 maintains its operating position in axial direction.

For maintenance purposes, the spinning rotor 1 can be pulled out of its bearing when required from the operator's side 20 of the spinning aggregate. The spinning rotor 1 can then be inserted again in the opposite direction into its bearing.

The rotor cup 2 rotates in low pressure chamber 22 of a rotor housing 21. The low pressure is generated by means of a suction draft in suction direction B. During operation, the open front side of the rotor cup 2 is closed by means of a cover 23 (indicated partially only), to which an extension 24 is applied which projects through the open front side of the rotor cup 2. In the extension 24, the opening of a fiber feed channel 25 as well as the initial part of a yarnwithdrawal channel (not shown) are located in the known way.

The spinning process in open-end rotor spinning is known to those in the field and needs no further explanation here.

As can be seen from FIG. 1, a gap 27 is present between the rear supporting disc pair 6 and the front side 26 of the step bearing housing 11, which gap 27 often becomes filled with fiber fly. A closed fiber ring forms hereby around the rotating shaft 3 of the spinning rotor 1. When, for maintenance purposes, the spinning rotor 1 is pulled from the operator's side 20 out from its bearing, the fiber ring collapses. When the spinning rotor 1 is inserted into its bearing again, fibers may be pushed by the shaft 3 through the front opening on the front side 26 of the step bearing housing 11 into the bearing. Thus the inside of the step bearing housing 11 or the inside of its lubricant cartridge can become full of trash to such an extent that the step bearing breaks down and comes to a standstill.

In order to avoid this unwanted situation, a tube 28 through which air can flow is guided, from the operator's side 20, into the area of the step bearing housing 11. This tube 28 comprises an entry opening 29 on the operator's side of the spinning aggregate as well as an opening 30 aligned in the gap 27 against the shaft 3. When, for example, a blower 31 of a travelling aggregate is placed at the entry opening 29, a flow of air is blown into the tube 28 according to the arrow direction C, which flow of air exits as shown by the air arrows D from the opening 30 thus blowing the fiber ring away from the shaft 3.

The only part of the blower 31 indicated is a connecting branch 32, which can be placed to the entry opening 29 at certain intervals.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A pneumatic cleaning system for an arrangement for open-end rotor spinning comprising a spinning rotor having a rotor cup and a rotor shaft which rotor shaft is supported by bearing means such that it can be pulled out towards an operator's side at the rotor cup end of the rotor shaft, which bearing means include at least one pair of disks for radial support of the rotor shaft and a step bearing for axial support of the rotor shaft, wherein the system further comprises an air tube beginning at the operator's side and ending close to the step bearing where it is directed towards the rotor shaft, said air tube being operable to blow cleaning air against the rotor shaft for cleaning fiber fly therefrom between the step bearing and the adjacent pair of disks.

2. Arrangement according to claim 1, wherein a blower is arranged at the entry opening of the tube.

3. An arrangement according to claim 2, wherein the blower is arranged on a travelling aggregate and can be selectively positioned at the entry opening.

4. A pneumatic cleaning system for a spinning rotor shaft which in use is supported by a bearing support including radial support disks and a step bearing, said rotor shaft being selectively removable from and insertable into the bearing support, said pneumatic cleaning system including an air tube opening toward a section of the rotor shaft intermediate a pair of the support disks and a step bearing housing for the step bearing, said air tube being operable to blow cleaning air against the rotor shaft to clean fiber fly therefrom.

5. A pneumatic cleaning system according to claim 4, comprising:

an air source which is selectively connectable with an inlet of the air tube for supplying cleaning air thereto.

6. A pneumatic cleaning system according to claim 5, wherein said air source is carried by a mobile unit which in use travels along and services a plurality of spinning stations with respective air tubes.

7. A pneumatic cleaning system according to claim 6, wherein said air source includes a blower.

8. A pneumatic cleaning system according to claim 5, wherein said air source includes a blower.

9. A method of operating a rotor spinning unit with a pneumatic cleaning system according to claim 4, comprising:

blowing cleaning air through the air tube against the rotor shaft to remove the fiber fly therefrom, removing the rotor shaft from the bearing support after removing the fiberfly therefrom and then reinserting the rotor shaft in the bearing support.

10. A method according to claim 9, wherein the rotor spinning unit is one of a plurality of commonly driven rotor spinning units, and wherein a travelling aggregate is provided for selectively blowing air at respective air tubes of the spinning units.

11. A method of operating an open-end rotor spinning arrangement which has a spinning rotor cup supported at a first end of a rotor shaft and a bearing assembly operable to support the rotor shaft during spinning operations while permitting selective removal of the rotor cup and shaft, said bearing assembly including a step bearing engageable with the rotor shaft at a second end thereof facing away from the first end and at least one pair of support disks radially engageable with the rotor shaft at a position spaced from the step bearing, said method comprising:

cleaning fiber fly from portions of the rotor shaft intermediate the step bearing and the support disks by directing blowing air against the rotor shaft to thereby prevent accumulation of fiber fly that could otherwise be pressed into the step bearing during removal and subsequent insertion of a rotor shaft in the spinning arrangement.

* * * * *